United States Patent [19]

Occhini et al.

[11] 4,417,093

[45] Nov. 22, 1983

[54] HIGH VOLTAGE DIRECT CURRENT CABLE WITH IMPREGNATED TAPE INSULATION

[75] Inventors: Elio Occhini; Gianmario Lanfranconi, both of Milan; Piero Metra, Varese, all of Italy

[73] Assignee: Societa Cavi Pirelli S.p.A., Milan, Italy

[21] Appl. No.: 327,353

[22] Filed: Dec. 4, 1981

[30] Foreign Application Priority Data

Jan. 14, 1981 [IT] Italy ..... 19115 A/81

[51] Int. Cl.[3] ..... H01B 7/14; H01B 9/02; H01B 9/06

[52] U.S. Cl. ..... 174/25 R; 174/25 C; 174/102 SC

[58] Field of Search ..... 174/23 C, 25 C, 25 R, 174/25 G, 102 SC, 105 SC, 106 SC, 120 FP; 361/315, 316, 319; 252/567, 570, 578, 579

[56] References Cited

U.S. PATENT DOCUMENTS

| | | | |
|---|---|---|---|
| 2,019,336 | 10/1935 | Clark | 252/578 |
| 2,475,592 | 7/1949 | Clark | 252/567 |
| 2,914,429 | 11/1959 | King | 174/25 C |
| 2,914,430 | 11/1959 | King et al. | 174/25 C |
| 3,145,258 | 8/1964 | Feick et al. | 174/25 R |
| 3,163,705 | 12/1964 | Feick et al. | 174/25 R |
| 3,445,394 | 5/1969 | Hunt | 174/25 C |
| 3,586,752 | 6/1971 | Mills | 174/25 R |
| 3,651,244 | 3/1972 | Silver | 174/102 SC X |
| 3,668,128 | 6/1972 | Anderson | 174/25 C |
| 3,811,077 | 5/1974 | Munch | 361/315 |
| 3,948,787 | 4/1976 | Munch | 252/579 |

FOREIGN PATENT DOCUMENTS

| | | | |
|---|---|---|---|
| 215506 | 6/1958 | Australia | 252/578 |
| 605747 | 9/1960 | Canada | 174/25 C |
| 2626103 | 12/1976 | Fed. Rep. of Germany | 252/579 |
| 51-13217 | 9/1980 | Japan | 252/579 |
| 767836 | 2/1957 | United Kingdom | 174/25 C |
| 1488811 | 10/1977 | United Kingdom | 252/579 |
| 593254 | 1/1978 | U.S.S.R. | 252/579 |

OTHER PUBLICATIONS

Constandinov, Dr. T. E., "The Electrical Resistivity of Insulating Papers", *Insulations/Circuits,* 6/1970, pp. 36–38.

Pohnan, Frank J., "Voids and Wax in Solid High-Voltage Cables", *AIEE Transactions,* vol. 70, Part II, 1951, pp. 1372–1375.

*Primary Examiner*—A. T. Grimley
*Assistant Examiner*—Morris H. Nimmo
*Attorney, Agent, or Firm*—Brooks, Haidt, Haffner & Delahunty

[57] ABSTRACT

A direct current, electric, submarine cable which may be used in long lengths and at great depths and which has improved voltage breakdown characteristics with respect to voids which form in the insulation. The cable has a conductor surrounded by an inner semi-conductive screen which is surrounded by cellulose paper tape insulation which is surrounded by an outer semi-conductive screen which is surrounded by a metal sheath. The paper tape is impregnated with a compound comprising a viscous hydrocarbon oil containing a substance having polar groups, the amount of the substance being sufficient to make the volume resistivity of the compound 100 times lower than the volume resistivity of the tape with the compound therein.

14 Claims, 4 Drawing Figures

HIGH VOLTAGE DIRECT CURRENT CABLE WITH IMPREGNATED TAPE INSULATION

The present invention relates to improvements in cables with compound impregnated insulation tapes which are either, fully impregnated, or under pressurized gas, and which are especially suitable for utilization with direct current and for working voltages of at least between 200 and 1000 kV.

The improved cables, according to the invention, are especially, but not exclusively, suitable for being employed as submarine cables.

In particular, the cables, according to the invention, prove to be efficacious for being applied wherever long distances underwater have to be covered (for example, over 100 Km).

As those skilled in the art know, the critical situation in a high voltage (H.V.) cable, is the formation of voids or bubbles in the insulation during the operation of the cable, due to the thermal cycles during the cooling phase.

The known cables, such as oil-filled (O.F.) cables, having their insulating tapes impregnated with a liquid dielectric having a low viscosity, are the cables which offer the best guarantee against bubbles being formed.

In fact, when the temperature is increased, the liquid dielectric or fluid oil, as it is commonly defined, expands into appropriate tanks, preferably, at a variable pressure, which, as needed, are disposed at one or both of the extremities of the cable.

In the cooling phase, the contraction becomes compensated by the fluid oil that reflows into the cable from the tank.

This is the reason why, in the insulation of the O.F. cables, no bubbles can form. Briefly, the O.F. cables are independent of any variations in temperature or rather, are thermally stable.

Moreover, since the fluid oil normally in use has a specific weight (as high as possible) very close to that of the water, the pressure inside the O.F. cables is approximately equal to that of the ambient wherein the cable is introduced. This fact permits the O.F. cables to not have, practically, any limits as far as the laying depths are concerned.

Under cooling conditions (as stated above) the fluid oil contracts, and must shift from the outer terminals of the cable to the center of the connection.

Due to the hydraulic resistance encountered, which is due, in part, to the viscosity of the oil, considerable drops in pressure are had throughout the cable lay-out.

It is comprehensible that these drops in pressure will be proportionately as great as the length of the O.F. cable. Hence, for preventing, during the cooling phase, in the case of very long cables, any pressure drops from taking place in the cable, it is necessary to increase the feed-pressure of the fluid oil. Clearly, however, said pressure cannot be increased indefinitely, and it results from this that the O.F. cables have some limitations when very long distances are involved.

For great distances, there has been proposed the use of cables with paper tapes that are pre-impregnated with a compound that is non-migrating in a pressurized gas atmosphere. Particularly, these cables are known in the art as GLOVER type cables. In practice, they comprise paper that is pre-impregnated with compound and in a pressurized gas atmosphere, for example, $N_2$, at pressure between the 14 and 15 atm.

The cables with a pressurized gas are not appropriate for great depths. In fact, a cable of this type cannot be laid at working voltage pressure, because, in such a case, it would not be flexible. Whenever, moreover, the external water pressure exceeds the inner gas pressure, the cable could collapse.

Experience has proven that, with a cable having an interal gas pressure, depths of over 250 meters cannot be exceeded.

Moreover, in a cable of the GLOVER type, bubbles can be formed during its manufacture, between the intervals or dielectric gaps. The tapes impregnated with compound, when wound and stretched tightly over the cable, squeeze out the compound which, on issuing forth, fills just partially the gaps between the tapes while leaving small voids on the inside.

This fact is not relevant for alternating current, where the distribution of the potential gradient takes place as a function of the dielectric constant of the insulation.

For d.c. cables where, as those skilled in the art know, the potentials are distributed on the basis of resistivity, bubbles in-between the gaps or intervals between the turns of the insulating tapes would represent a considerable electrical discharge risk.

In fact, the resistivity of the bubbles being practically infinite, there becomes localized on them a gradient that is very high with respect to the gradient that could be localized astride of the bubble should it be filled with a compound.

Cables that can function well for long distances and also for great depths, are those entirely impregnated with compound and lead-coated, whether they have a cross-section with a circular or an elliptical perimeter.

As those skilled in the art know, these cables do not have any substantial longitudinal movement and move only in the radial sense. As a matter of fact, during the thermal cycles, there are had, alternately, thermal expansions and contractions of the compound. With constant external pressure, during the heating and the radial expansion of the compound, there is had an increase in the internal pressure.

During the successive cooling phase, for the purpose of the thermal contraction, the internal pressure is reduced until there exists, at certain points, an absolute vacuum.

In correspondence to these points, voids can be formed in the compound, at least initially, under a hard vacuum which, in d.c. cables, (for reasons stated above) can bring about the electrical perforation of the insulation. Direct current cables, completely impregnated with a compound, were used till a few decenia ago, for voltages below 200 kV and usually around about 100 kV.

However, as known, the working voltages for a d.c. cable has gradually been increased, while, in like manner, the value attributed to the term "high voltages" has gradually undergone a change. Today, by the term "high voltages", voltages which have values that are 200 kV or higher are meant.

On said increasing of the working voltages, appropriate for a cable, the technique has gradually adapted the insulation to the increased stresses by means of increasing the insulation thickness and by employing compounds having elevated insulating characteristics.

In spite of this, the perforations, occurring during the thermal cycles, have not been obviated. Rather, it has been found from experiment, for example, that with a sample of d.c. cable insulated with cellulose paper impregnated with a compound and having a thickness of 9 mm, electrical discharges have occurred when a testing voltage of about 400 kV has been applied, whereas for a d.c. cable insulated with the same impregnated paper, but having a thickness of 18 mm, electrical perforations, due to electrical discharges, were not prevented when a testing-voltage of 800 kV was applied. On the contrary, such discharge occurred at about 600 kV.

Said phenomenon can be correlated with the formation of voids which become verified to a greater extent and with more serious effects, depending upon the amount of compound involved. The quantity of the compound increases the possibility of perforations taking place as a consequence.

If a submarine and completely impregnated cable is laid at a sufficient depth (of over 120 m), the external pressure, due to the water, can be transmitted through the plastic sheath to the insulation, thus preventing the above phenomena. But, unfortunately, for depths of less than 120 m, the effect of the external pressure is insufficient, and any good results, for high voltage d.c. cables, which are completely impregnated and of a considerable length, are purely aleatory.

The present invention has the object of providing d.c. cable constructions for high voltages, especially, but not exclusively, suitable for being employed for long distance underwater stretches, which give the best guarantee with respect to electrical discharges during use of the cables even where they are not aided by the pressure of the surrounding ambient. For this purpose, the Applicant employs a tape impregnating compound which is less insulating than those commonly used, and which can screen electrically, or short-circuit, any bubbles found contained therein.

More precisely, the object of the present invention is an improved electric cable, especially suitable for being used for direct current and for working voltages of between 200 and 1000 kV, which cable comprises at least one conductor, an internal semi-conductive screen, a dielectric consisting of at least one or more layers of insulating tapes of cellulose paper wound helicoidally around said internal semi-conductive screen and impregnated with a coumpound, and the layers being surrounded by at least one outer semi-conductive screen and by a metallic sheath, characterized by the fact that, in the temperature range to be encountered during use of the cable, said compound has a sufficiently low resistivity, at least 100 times lower than that of said cellulose paper tapes impregnated with the compound so that, in effect, the compound acts as an electrical screen around any bubbles contained therein, the low resistivity value of the compound being obtained by the presence in the latter of at least one substance containing polar groups.

The invention will be better understood from the following description which makes reference, solely by way of example, to the FIGURES of the attached drawing sheets, wherein.

Figure 1:
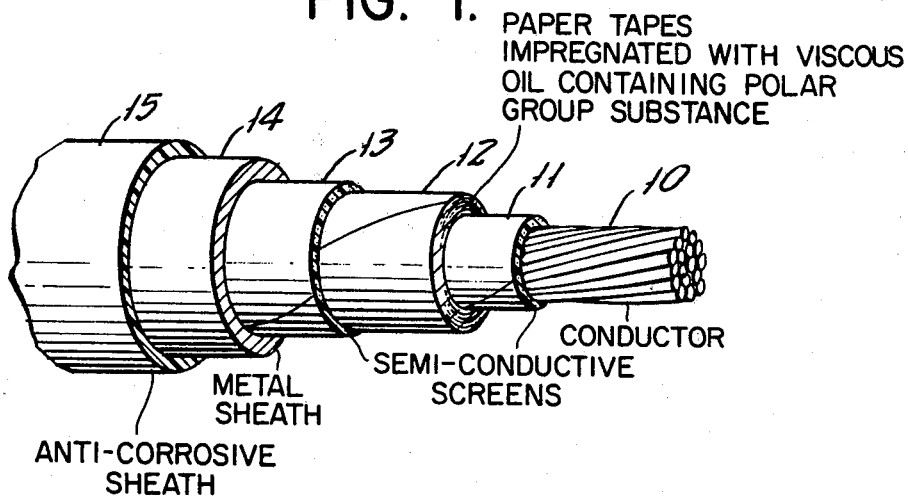
FIG. 1 represents schematically, a fully impregnated length of cable for direct currents.

The cable for direct currents, shown in FIG. 1, comprises at least one conductor 10 on which there is disposed an internal semi-conductive screen 11 obtained for example, by winding a semi-conductive tape.

On the semi-conductive screen 11, there is present the dielectric, consisting at least of one or more layers of an insulating, cellulose paper tape 12, wound helically and impregnated with a compound.

On the insulating tape 12, there is disposed the external semi-conductive screen 13. The latter could be constituted, for example, by a wound, semi-conductive tape. The elements described are enclosed in at least one lead sheath 14. The latter could also be covered with protective layers, known in the art, or else protective layers which are rendered necessary by particular circumstances.

In the example illustrated in FIG. 1, the lead sheath 14 is covered by an anti-corrosive sheath 15. The Applicant has surprisingly found that it is possible to obviate the danger represented by voids or bubbles, which are embedded in the compound, if they are already present, or else if they should be formed during the thermal cycles, if the compound presents at the design operating temperatures, a sufficiently low resistivity which is maintained constant throughout the working range.

A compound with the characteristics set forth in the preceding paragraph, is such as to be able to electrically screen any voids or bubbles contained therein.

It has been proven experimentally that, for achieving an efficacious screening of bubbles or voids, it is necessary for the compound to have a resistivity at least 100 times lower than that of the cellulose paper tapes impregnated with the compound.

However, preferably, but not exclusively, the resistivity will be about 100 times lower than that of such impregnated paper tapes.

A compound which follows the teachings of the invention, can be obtained by adding to the hydrocarbon oil, commonly used for impregnating electrical cables, at least one substance containing polar groups, meaning that the compound could contain one or more polar groups. For a definition of the term "substance containing polar groups", reference is made to the American edition of Samuel Glasstone's 'TRATTATO DI CHIMICA-FISICA' at pages 114–115 of the Italian translation (1956) by Carlo Manfredi Editors.

One example of said compound comprises:

Viscous hydrocarbon oil in the proportion of at least 60 parts by weight per every 100 parts by weight of compound.

Organic polar compositions wherein the polarity is given by the presence in the compound of one or more carboxylic groups —CO—OH, in the measure of up to 40 parts by weight per every 100 parts by weight of the compound.

In addition to these two components, others can also be present, for example, for modifying the viscosity of the compound, in proportions up to 15% of the weight of the two preceding compounds.

In particular, a compound which has given excellent results, comprises:

63 parts by weight of a hydrocarbon oil having an index of viscosity 75 and a viscosity at 38° C. of 800 cSt.;

27 parts by weight of an organic composition consisting essentially of a natural resin with an abietic acid base;

10 parts by weight of microcrystalline wax having its melting point in the range from 103°-107° C.

Figure 2:
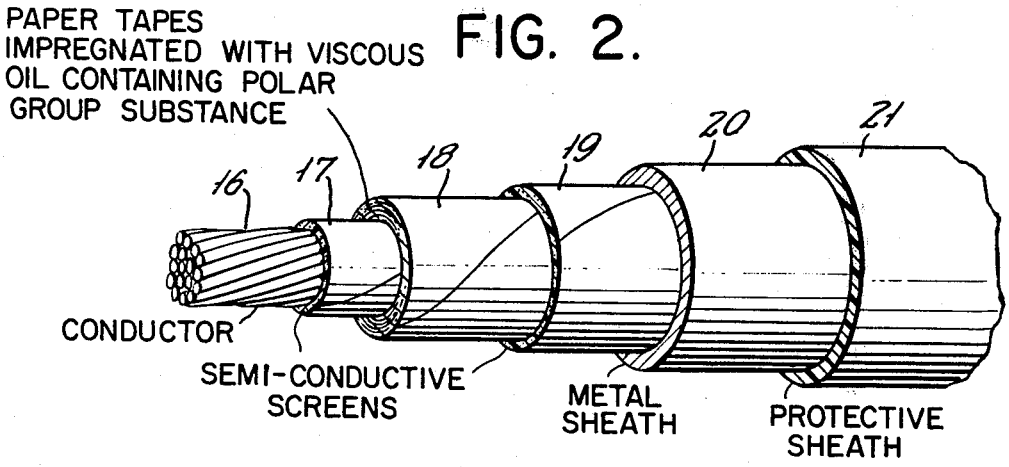
FIG. 2 illustrates schematically, a length of d.c. cable pressurized with gas.

The latter recipe has proved itself to be particularly efficacious both for the cable illustrated in FIG. 1 and for the cable illustrated in FIG. 2.

The latter cable has at least one conductor 16, covered by an internal screen 17 and having the dielectric constituted by insulating cellulose paper tapes 18 wound helically.

An outer screen 19 covers the insulating tapes 18. The elements named are contained in at least one metallic sheath 20, for example, a corrugated aluminium sheath.

Figure 3:
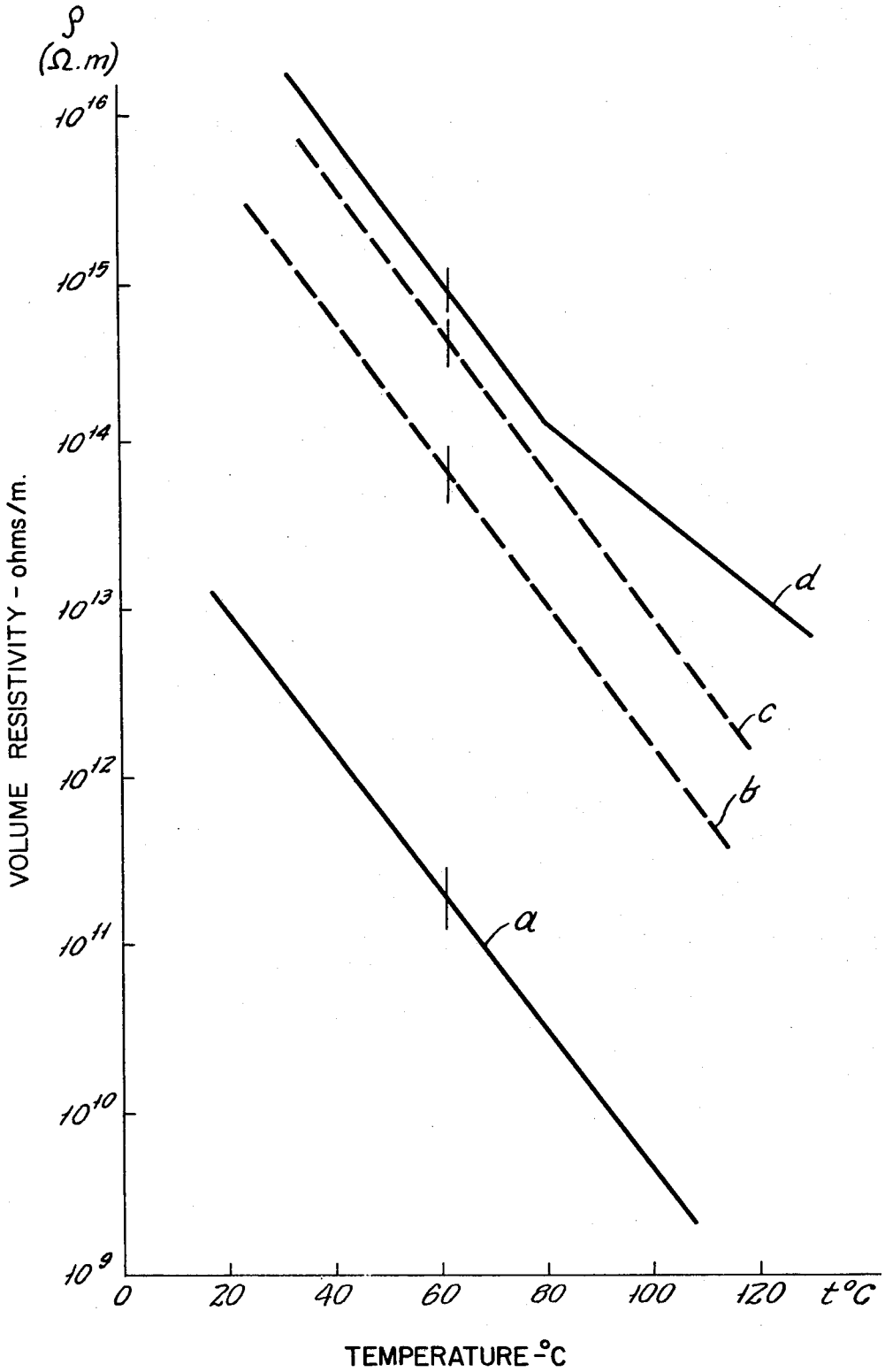
FIG. 3 is a diagram which illustrates the volume resistivity of certain compounds in relation to the resistivity of the paper.

The sheat 20 could be covered by one or more protective sheaths 21. The insulating tapes 18 of the cable in FIG. 2 are of the type impregnated with a compound with the aid of gas pressure, for example, $N_2$ at pressures that can reach up to 25 atm. FIG. 3 shows the variation curve (a), of the volume resistivity as a function of the temperature of the last-mentioned said compound in relation to the variations of the volume resistivity of the paper impregnated with it (curve b).

A compound prepared with the product IL03 (white vaseline) made by the company WITCO (U.S.A.), previously and commonly used, has a volume resistivity shown by and has a resistivity approximate to and higher than that of the paper which it impregnates (curve c) has not given very satisfactory results.

Figure 4:
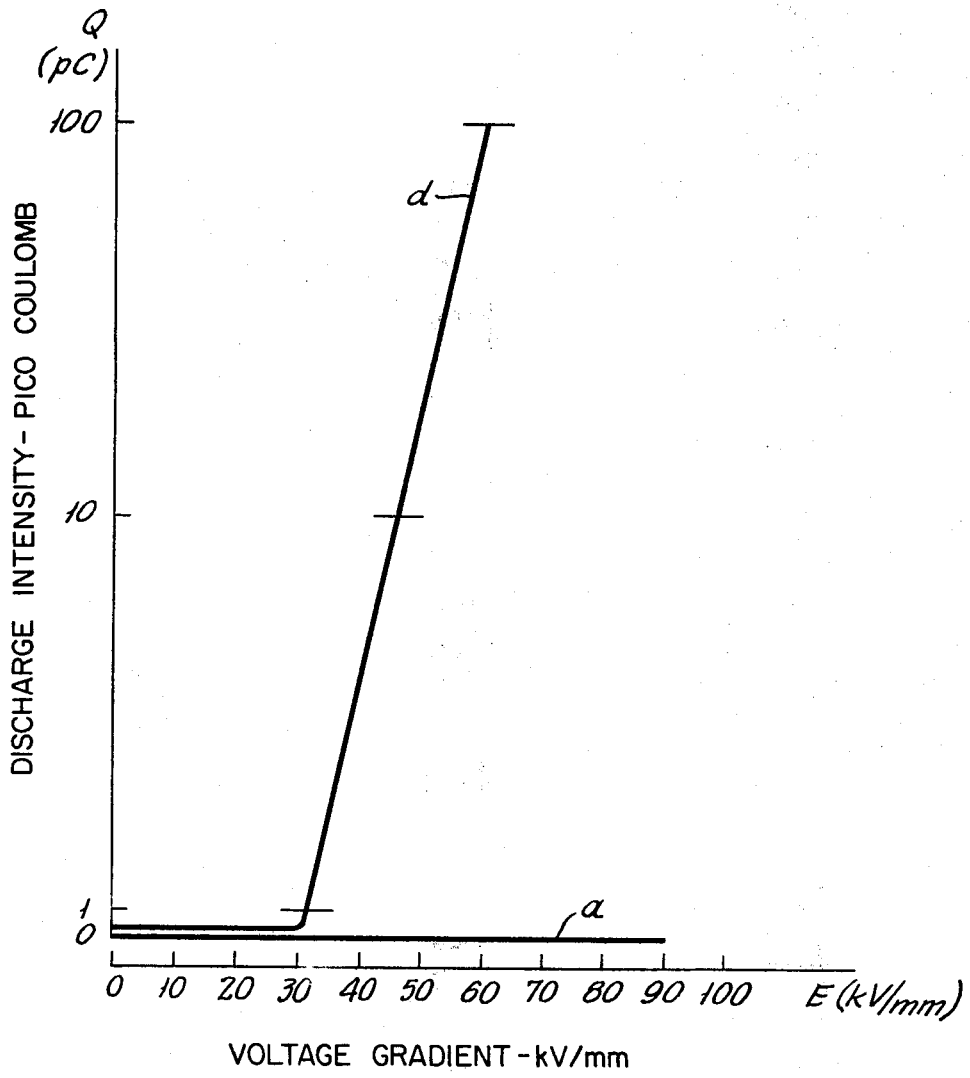
FIG. 4 is a diagram that shows the discharge intensity with a compound according to the invention in relation to the electrical discharge intensity of a compound of the prior art.

In fact, one can observe from the diagram of FIG. 4, which shows the intensity of the discharges expressed in picoCoulomb (pC) at 14 atm as a function of the applied gradient E, expressed in KV/mm, for bubbles in test pieces with dielectric impregnated, respectively, with the compound of the invention and the prior art compound, that the compound according to the invention has a gradient three times greater than that at which the discharges are initiated in the traditional compound (curve d), no discharges occurring in the compound according to the invention at up to 90 Kv/mm. (curve a).

Other preferred compounds are those containing, in addition to a hydrocarbon oil having a viscosity at 38° of 800cSt. one of the following organic acids, in proportions up to 10%:

Oleic Acid
Linolic Acid
Recinoleic Acid
Palmitic Acid
Stearic Acid
Various Naphthenic Acids
Various Terpenic Acids.

Other compounds in accordance with the invention can comprise, for example, viscous hydrocarbon oil to which have been added salts of organic acids having a good solubility in the hydrocarbons.

A compound of this type, which has shown to be particularly suitable, comprises a hydrocarbon oil having a viscosity at 38° C. of 600cSt in the proportion of 95 or more parts by weight per 100 parts by weight of compound and copper naphthenate up to 5 parts by weight per 100 parts by weight of the compound.

A further preferred compound can consist of a hydrocarbon oil, such as those set forth in the previous examples, which contain compositions containing polar groups or conductive particles which originate from the cellulose paper tapes, when an aqueous extract from said tapes has a conductivity of from 50 to 200μ SIEMENS.

For determining the aqueous extract and for measuring its conductivity, reference is made to the ASTM D 202-62T method.

The conductivity of the aqueous extract of the paper can be defined as a measure of the soluble-in-water electrolytes which are found present in the paper.

Although only certain types of compounds have been cited, the invention must be considered extensible to all those types of compounds of which the characteristics as well as the resistivity enter within its purview, either for being used with fully impregnated cables or for cables having an external pressure.

Hence, the details of realization of the invention can vary according to need without, however, departing from the scope of the invention.

What is claimed is:

1. A direct current, electric, submarine cable for an operating voltage of at least 200 kilovolts and adapted for use in lengths of at least 100 kilometers and at substantial depths under water, said cable comprising:

a conductor;

an inner, semi-conductive screen around, and conductively connected to, said conductor;

an outer, semi-conductive screen around and spaced from said inner semi-conductive screen;

a metallic sheath around said outer semi-conductive screen; and solid insulation intermediate said inner semi-conductive screen and said outer semi-conductive screen; said insulation comprising insulating material which is impregnated with a compound comprising at least a viscous hydrocarbon oil and at least one substance containing polar groups, said compound having a resistivity in the temperature operating range of the cable at least 100 times lower than the resistivity of said insulating material impregnated with said compound;

said cable being characterized by a voltage breakdown resistance with voids in the insulation which is greater than the voltage breakdown resistance of the same cable without said compound.

2. A direct current, electric, submarine cable as set forth in claim 1 wherein said insulating material is cellulose paper tape which is wound helicoidally around said inner semi-conductive screen.

3. A direct current, electric, submarine cable as set forth in claim 2 wherein said insulation fills the space between said inner semi-conductive screen and said outer semi-conductive screen.

4. A direct current, electric, submarine cable as set forth in claim 1 wherein the resistivity of said compound is substantially 100 times lower than the resistivity of said insulating material impregnated with said compound.

5. A direct current, electric, submarine cable as set forth in claim 1 wherein said substance is an organic substance.

6. A direct current, electric, submarine cable as set forth in claim 5 wherein said organic substance contains at least one carboxylic group and said compound contains up to 40 parts by weight of the compound of the organic substance, said viscous hydrocarbon oil in an amount to make 100 parts by weight and up to 15% of the 100 parts by weight of other substances.

7. A direct current, electric, submarine cable as set forth in claim 6 wherein said other substances are substances for modifying the viscosity of said compound.

8. A direct current, electric, submarine cable as set forth in claim 5 wherein said organic substance is selected from the group consisting of a natural resin with an abietic acid base, oleic acid, linolic acid, recinoleic acid, palmitic acid, stearic acid, napthenic acids, terpenic acids and mixtures thereof.

9. A direct current, electric, submarine cable as set forth in claim 5 wherein said compound comprises about 27 parts by weight of a natural resin with an abietic acid base, about 10 parts by weight of a microcrystalline wax having a melting point in the range from 103–107° C., and 63 parts by weight of a hydrocarbon oil having an index of viscosity of 75 and a viscosity at 38° C. of about 800 centistokes, the parts by weight being based on the total weight of the natural resin, the microcrystalline wax and the hydrocarbon oil.

10. A direct current, electric, submarine cable as set forth in claim 5 wherein said compound comprises up to 5 parts by weight of copper naphthenate and at least 95 parts by weight of a hydrocarbon oil having a viscosity at 38° C. of about 600 centistokes, the parts by weight being based on the total weight of the compound.

11. A direct current, electric, submarine cable as set forth in claim 5 wherein said compound comprises up to 10 parts by weight of said organic substance and said hydrocarbon oil has a viscosity at 38° C. of about 800 centistokes.

12. A direct current, electric, submarine cable as set forth in claim 11 wherein said organic substance is oleic acid.

13. A direct current, electric, submarine cable as set forth in claim 1 wherein said hydrocarbon oil has a viscosity at 38° C. in the range from about 600 to about 800 centistokes, said insulating material is cellulose paper tape containing said substance, an aqueous extract of said substance taken from the tape having a conductivity in the range from about 50 to about 200$\mu$ Siemens.

14. A direct current, electric, submarine cable as set forth in claim 1 wherein said compound has gas under a pressure above atmospheric pressure applied thereto.

* * * * *